United States Patent [19]

Hosokawa et al.

[11] 4,260,478

[45] Apr. 7, 1981

[54] APPARATUS FOR CLASSIFYING PARTICLES

[75] Inventors: Masuo Hosokawa, Toyonaka; Tohei Yokoyama, Kuse; Katsuya Mizui, Yahata; Haruhisa Yamashita, Hirakata; Kouichi Doi, Yahata, all of Japan

[73] Assignee: Kabushiki Kaisha Hosokawa Funtai Kogaku Kenkyusho, Osaka, Japan

[21] Appl. No.: 98,275

[22] Filed: Nov. 28, 1979

[30] Foreign Application Priority Data

| | | | |
|---|---|---|---|
| Nov. 24, 1978 | [JP] | Japan | 53-145802 |
| Dec. 6, 1978 | [JP] | Japan | 53-151582 |
| Feb. 2, 1979 | [JP] | Japan | 54-13321[U] |
| May 28, 1979 | [JP] | Japan | 54-65809 |

[51] Int. Cl.[3] ..... B04C 5/06; B07B 7/083

[52] U.S. Cl. ..... 209/139 A; 209/144

[58] Field of Search ..... 209/139 A, 144, 145, 209/147, 148; 55/400, 408, 409

[56] References Cited

U.S. PATENT DOCUMENTS

| | | | |
|---|---|---|---|
| 2,693,876 | 11/1954 | Ostman | 209/148 X |
| 3,402,815 | 9/1968 | Jarreby | 209/144 X |
| 3,670,886 | 6/1972 | Hosokawa et al. | 209/144 X |

*Primary Examiner*—William A. Cuchlinski, Jr.
*Attorney, Agent, or Firm*—Edwin E. Greigg

[57] ABSTRACT

An apparatus for classifying particles comprising a main body having a fine particle outlet and a coarse particle outlet, a classifying fan wheel disposed within the main body, and a first gas inlet channel for supplying the particles to the interior of the main body along with a gas stream. The apparatus further includes a gas passing member having a large number of gas inlets opened toward the direction of rotation of the fan wheel, and a second gas inlet channel for supplying a gas stream to the space between the gas passing member and the inner wall surface of the main body.

7 Claims, 8 Drawing Figures

APPARATUS FOR CLASSIFYING PARTICLES

BACKGROUND OF THE INVENTION

This invention relates to an apparatus for classifying particles comprising a main body having a fine particle outlet and a coarse particle outlet, a classifying fan wheel rotatably disposed within the main body and having an inside space in communication with the fine particle outlet, and a first gas inlet channel communicating with the interior of the main body for supplying the particles to be classified (hereinafter referred to simply as "particles") to the fan wheel externally thereof along with a gas flow.

With classifying apparatus of this type, the particles supplied thereto as entrained in a flow of gas are given a centrifugal force by a classifying fan wheel rotating within the main body of the apparatus, while the gas is adapted to pass through the fan wheel and flow out from the apparatus. The difference between the centrifugal force and the centripetal force simultaneously given to the particles in the gas flow acts to selectively separate the particles. For this operation, it is desired that the particles be thoroughly dispersed through the gas flow, but conventional apparatus are unable to effect full dispersion, with the result that some fine particles among the particles are likely to remain agglomerated without separating into individual particles and flow into a coarse particle zone to mingle with coarse particles. This leads to reduced fine or coarse particle collection efficiency and lower classification efficiency.

SUMMARY OF THE INVENTION

The present invention, accomplished to overcome the above drawback heretofore experienced, provides an apparatus characterized by a gas passing member disposed within the main body of the apparatus to surround a classifying fan wheel at a suitable spacing and having a large number of gas inlets opened toward the direction of rotation of the fan wheel, by the above-mentioned gas inlet channel communicating with the interior of a classifying chamber provided inside the gas passing member, and by a second gas inlet channel communicating with the interior of a gas chamber formed between the gas passing member and the inner wall surface of the main body.

Because of this feature, the coarser particles which are subjected to a centrifugal force greater than the centripetal force acting thereon will be dispersed effectively by the gas flowing into the gas passing member through the inlets formed in the member, when the particles are moved toward the inner wall surface of the gas passing member. With the conventional apparatus, coarser particles, when subjected to a centrifugal force given by the fan wheel and greater than the centripetal force exerted thereon by the gas flow from the first gas inlet channel, will then descend the inner wall surface of the main body and flow out from the apparatus through the coarse particle outlet, whereas according to this invention, the coarser particles contrifugally forced outward from the fan wheel are further acted on by the gas introduced from the gas chamber through the inlets and are thereby dispersed. Consequently the fine particles adhering to coarse particles or in the form of agglomerates are separated and carried toward the fan wheel and then subjected to a separating action again. Thus one particle will be acted on for dispersion and separation more frequently than is conventionally possible.

In this way, the apparatus of this invention assures dispersion and classification with improved effectiveness, greatly reducing the likelihood that fine particles will be drawn off from the coarse particle outlet in the form of agglomerates or as adhered to or mixed with coarse particles. Coarse particles or fine particles can therefore be collected with improved efficiency to afford a product of high quality.

Other objects and advantages of the invention will become apparent from the following description.

BRIEF DESCRIPTION OF THE DRAWINGS

The drawings show classifying apparatus for particles embodying the invention.

DESCRIPTION OF THE PREFERRED EMBODIMENTS

Figure 1:
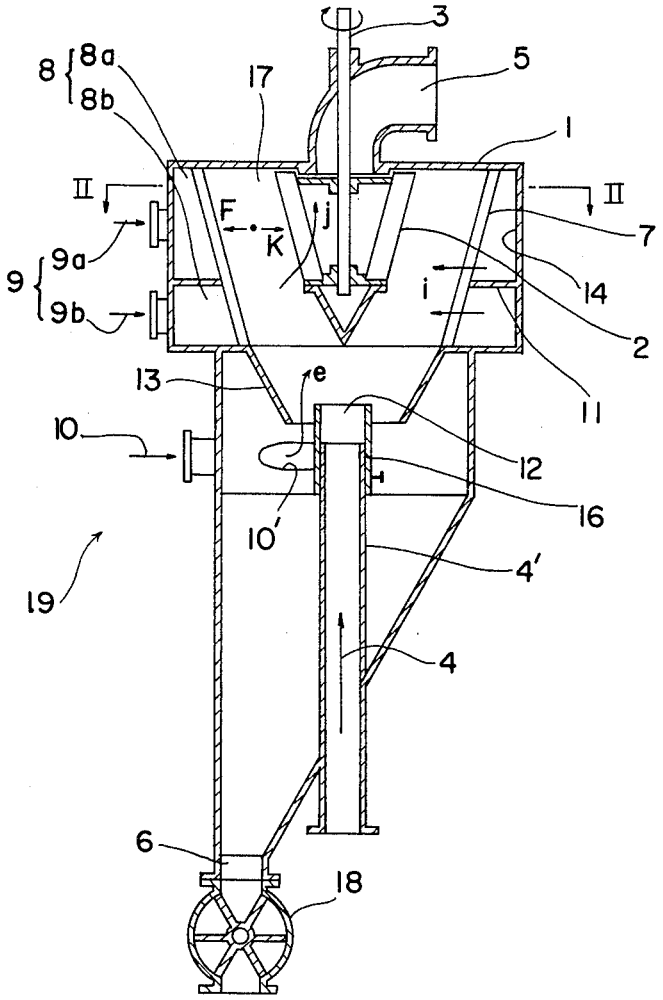
FIG. 1 is a front view in vertical section showing the main body of a classifying apparatus.
Figure 2:
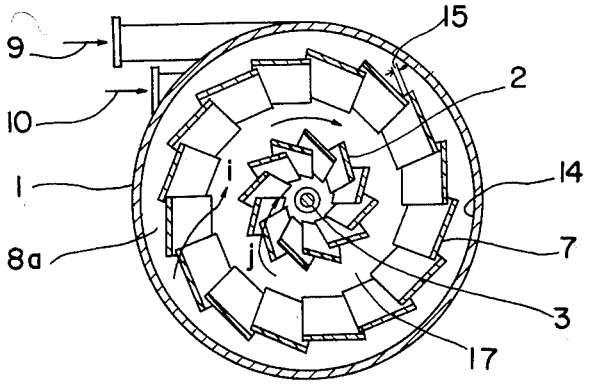
FIG. 2 is a cross sectional view taken along the line II—II in FIG. 1.

With reference to FIGS. 1 and 2, the main body 1 of a classifying apparatus has in an upper portion of its interior a classifying fan wheel 2 which is rotatably supported by a rotary shaft 3 and which forms an inverted conical outer periphery when driven. A fine particle outlet 5 is in communication with the inside space of the fan wheel 2. A gas passing member 7 surrounding the fan wheel 2 at a suitable spacing has gas inlets 15 which are opened in the form of slits toward the direction of rotation of the fan wheel 2. A classifying chamber 17 is provided inside the gas passing member 7, and a gas chamber 8 is formed between the gas passing member 7 and the inner wall surface 14 of the main body 1. A second gas inlet channel 9 is in communication with the gas chamber 8. The gas chamber 8 of the illustrated embodiment is divided by a partition 11 into gas chambers 8*a* and 8*b*, which are provided with second gas inlet channels 9*a* and 9*b* respectively. The two chambers, nevertheless, are in no way limitative.

The classifier main body 1 is provided, at its lower portion, with an inlet duct 4' providing a first gas inlet channel 4 for supplying particles as entrained in a gas flow, a coarse particle outelt 6 for drawing off the separated coarser particles from the apparatus, an inlet 10' for a third gas inlet channel 10 for introducing a gas which serves to pneumatically screen the material flowing toward the coarse particle outlet 6, and a pneumatic screen ring 13 continuous with the gas passing member 7 and providing a pneumatically screening portion. The inlet duct 4' has an opening 12 opposed to and concentric with the fan wheel 2. The position of the opening 12 is adjustable relative to the fan wheel 2 and to the ring 13 in accordance with the operating conditions involved. With the illustrated embodiment, the opening 12 is so adjustable by an adjusting tube 16 fitting around the inlet duct 4'. The position of the opening can be made adjustable from outside the apparatus when the adjusting tube 16 is movably fitted in the inlet duct 4. Furthermore, the screen ring 13 can be rendered detachable for replacement by another ring of suitable inside diameter.

Although the fan wheel 2 of the present embodiment is adapted to form an inverted conical outer periphery when driven, with the gas passing member 7 shaped in conformity with the configuration of the fan wheel 2, the fan wheel 2 can be shaped otherwise, or the gas passing member 7 can be cylindrical for the practice of this invention. While the second gas inlet channels 9*a* and 9*b* and the third gas inlet channel 10 extend in the same direction as the rotation of the fan wheel 2 and are opened tangentially of the frame of the main body 1 in communication with the interior thereof to cause the gas to flow through the member 7 and through the screen ring 13 uniformly with stability, the direction in which these channels are open is not particularly limited. The gas passing member 7 of the illustrated embodiment comprises planar bladelike pieces held at a specified spacing, inclined toward the direction of rotation of the wheel 2 and arranged with the adjacent edges lapping over each other, but the bladelike pieces may be those curved along the line of flow or plates punched with bores inclined toward the direction of rotation of the wheel 2, provided that the gas passing member 7 has relatively small apertures inclined toward the direction of rotation of the wheel 2 or extending nearly tangentially of the inner periphery of the member 7 and arranged uniformly along the inner periphery of the member 7. Attached to the coarse particle outlet 6 is a rotary valve 18, which is replaceable by any of various hermetic stop valves.

The apparatus will operate in the following manner. The material sent into the classifier main body 1 through the inlet duct 4' as entrained in a gas stream is agitated by the conveying gas stream and a swirling gas stream produced by the rotation (in the direction indicated by an arrow in FIG. 2) of the fan wheel 2 and is dispersed and separated into individual particles. The material is also subjected to a centrifugal force F resulting from the rotation of the fan wheel 2 and, at the same time, to a centripetal force K given by a gas stream j toward the center of the fan wheel 2. When the speed of rotation of the fan wheel 2 and the velocity of the gas stream toward the center of the fan wheel 2 are adjusted to predetermined values, the particulate material is subjected to the desired separating action, by which finer particles on which the centripetal force K is predominant are drawn toward the center portion of the fan wheel 2 along with the gas stream j, then run off from the apparatus through the fine particle outlet 5 and thereafter separated from the gas by an unillustrated trap and collected therein. On the other hand, the coarse particles acted on predominantly by the centrifugal force F are forced radially outward of the fan wheel and reach the inner peripheral portion of the gas passing member 7.

Because of the provision of the gas passing member 7 which is an essential feature of the invention, the dispersing action afforded by the particle-laden gas stream and by the swirling gas stream resulting from the rotation of the fan wheel 2 is greatly enhanced by another gas stream i flowing into the gas passing member 7 along the inner periphery thereof from the secondary gas inlet channels 9*a* and 9*b* through the inlets 15 in the member 7. The material supplied with the conveying gas stream is rapidly dispersed and thereafter carried to the outer peripheral portion of the fan wheel for reseparation. Since the gas stream i is introduced through the inlets 15 uniformly over the entire circumference of the member 7 at an extremely high velocity as if forming a film of gas flowing at a high speed, the gas stream i produces a vigorous agitating action upon joining the conveying gas stream and the swirling gas stream resulting from the rotation of the fan wheel 2. Consequently the entrained material can be dispersed and separated into individual particles with extremely high efficiency.

After having been thus subjected to the separating action repeatedly, the material still remaining in the coarse particle zone descends the inner wall surface of the gas passing member 7. When passing through the screen ring 13, the material is pneumatically screened by an ascending gas stream e introduced through the third gas inlet channel 10 and thereby dispersed and separated. As a result, the fine particles still adhering to and mingling with coarser particles are separated off, entrained in the conveying gas stream and subjected to reseparation. The fine particles eventually flow out from the fine particle outlet 5 through the fan wheel 2. The coarse particles pass through the screen ring 13, fall and are run off from the apparatus through the coarse particle outlet 6 for collection. In this way, the material fed to the classifying apparatus 19 according to the present embodiment is repeatedly dispersed and separated. With the same particle repeatedly subjected to classification, improved efficiency will result.

Figure 3:
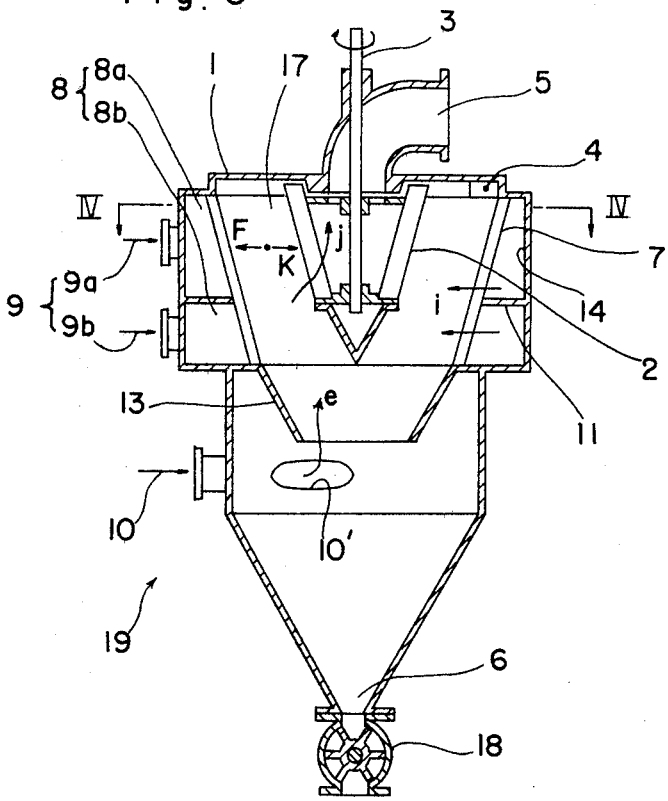
FIG. 3 is a front view in vertical section showing the main body of another embodiment.
Figure 4:
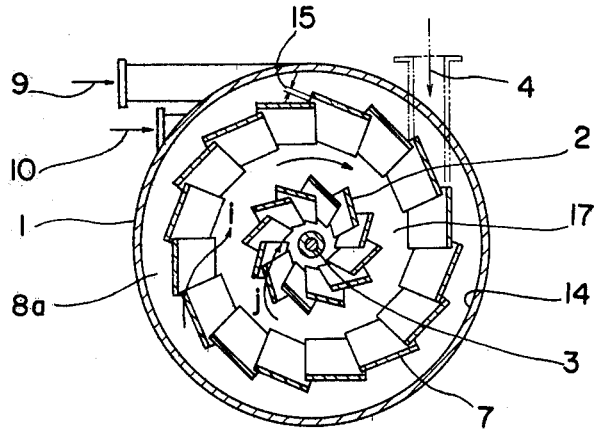
FIG. 4 is a cross sectional view taken along the line IV—IV in FIG. 3.

Although the first gas inlet channel 4 has an open end below the fan wheel 2 according to the first embodiment described above, the open end can be in any position, provided that it is exposed to the classifying chamber 17. As in the second embodiment shown in FIGS. 3 and 4 for example, the open end of the first gas inlet channel 4 can be positioned at one side of the fan wheel 2 to cause the channel 4 to feed the particle-laden gas in the direction of rotation of the fan wheel 2. Although not particularly shown, the open end of the first gas inlet channel 4 can alternatively be positioned above or at a side portion of the main body 1 to feed the material in the same direction as the axis of the rotary shaft 3 of the fan wheel 2. Since the second embodiment has the same construction as the first embodiment except for the position of the open end of the channel 4, like parts are referred to by like reference numerals throughout FIGS. 1 to 4 without giving a further description.

Figure 5:
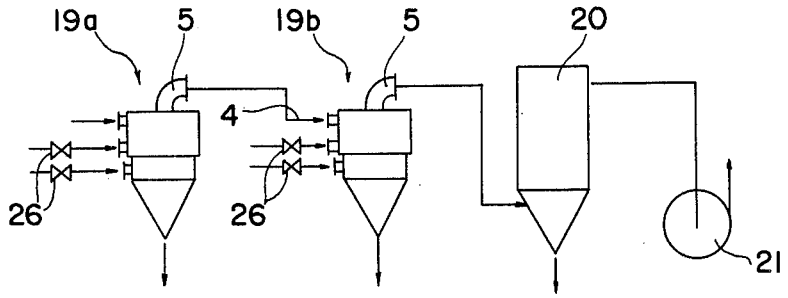
FIGS. 5 and 6 are flow charts each showing an operation line incorporating the present apparatus.
Figure 6:
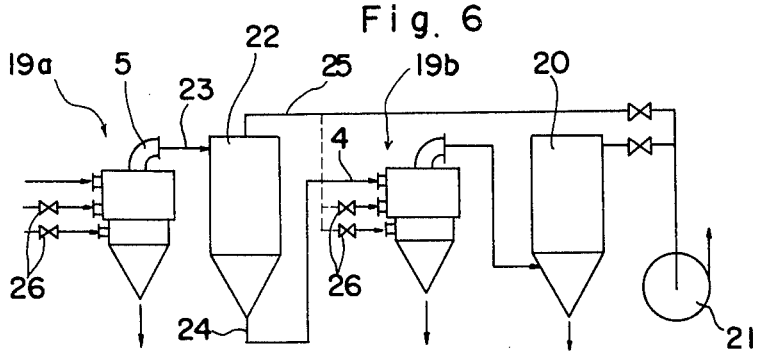

It is of course possible to use a cyclone collector, bag filter or like trap as well as a fan in communication with such a single classifying apparatus 19, while a plurality of classifying apparatus 19 are also usable as connected together in communication. FIGS. 5 and 6 show examples of such an arrangement.

FIG. 5 shows two classifying apparatus 19*a* and 19*b* as directly connected together in communication. The fine particle outlet 5 of the first classifying apparatus 19*a* is in communication with the first gas inlet channel 4 of the second classifying apparatus 19*b*. The fine particle outlet 5 of the second apparatus 19*b* communicates with a fan 21 by way of a trap 20 such as a bag filter. FIG. 6 shows a first classifying apparatus 19*a* and a second classifying apparatus 19*b*, with a cyclone collector or like gas-solid separator 22 connected between these apparatus in communication therewith. The fine particle outlet 5 of the first apparatus 19*a* is in communication with a gas and solid inlet channel 23 for the separator 22, which has a solid outlet channel 24 communicating with the first gas inlet channel 4 of the second apparatus 19*b*. The separator 22 has a gas outlet channel 25 communicating directly with a fan 21. When desired, the gas through the gas outlet channel 25 of the separator 22 may be used as a gas supply source for the second apparatus 19*b*, or the apparatus 19*b* may be provided with another gas supply source upstream from the first gas inlet channel 4 thereof. The arrangement of FIG. 6 is similar to that of FIG. 5 with respect to the other construction. Indicated at 26 are valves for regulating the gas flow.

When the speed of rotation of the classifying fan wheels of the apparatus 19*a* and 19*b* and the flow of gas into these apparatus are set at optimum values, it is possible to obtain coarse particles from the first apparatus 19*a*, particles of intermediate size from the second apparatus 19*b* and fine particles from the trap 20. Thus the particles supplied can be separated into three portions of different sizes at the same time. It is further possible to classify the charge into a larger number of portions with use of an increased number of classifying apparatus 19.

Figure 7:
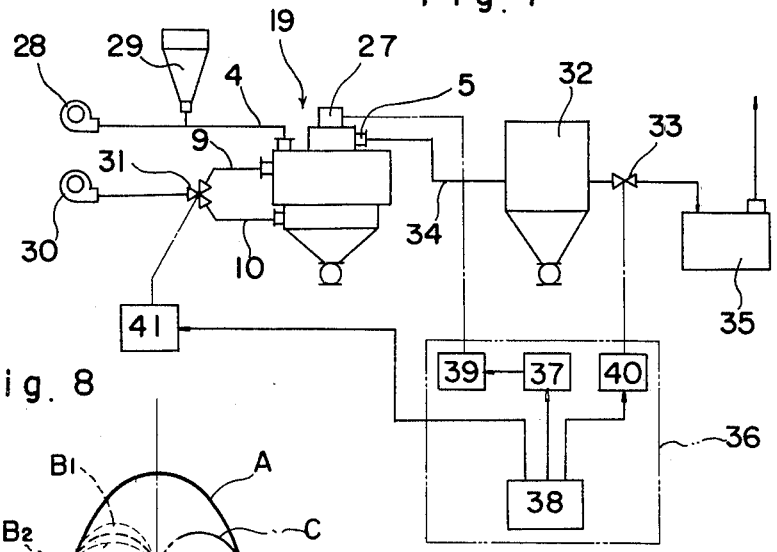
FIG. 7 is a flow chart showing a modification of the present apparatus.

The classifying apparatus 19 described can be improved for more sophisticated classification and for a wider variety of uses as will be described below. When particles are to be separated into a coarse fraction and a fine fraction by the classifying apparatus 19, the fine particles should not mingle with the coarse particles even if partially from the viewpoint of classification efficiency. Actually, nevertheless, there sometimes arises the need to collect particles of the desired particle size distribution such that a certain proportion of fine particles, for example, are intentionally included in a coarse fraction. FIG. 7 shows an improvement which gives a fraction of specified size with improved classification efficiency and which is also adapted to afford a fraction of the desired particle size distribution by intentionally incorporating thereinto particles of different sizes that otherwise would be separated off.

Indicated at 19 is a classifying apparatus having the same construction as the apparatus already described except that there is provided speed-variable drive means 27 for driving the rotary shaft 3 of the classifying fan wheel 2. The first gas inlet channel 4 is in communication with a fan 28 serving as a gas source and is equipped with a feeder 29 for supplying particles to the apparatus at a predetermined rate. Another fan 30 is provided as the gas source for the second and third gas inlet channels 9 and 10. A ratio control valve 31 is disposed at the junction of the inlet channels 9 and 10 for varying the gas flow ratio between the two channels 9 and 10 without varying, or without substantially varying, the combined gas flow through the channels 9 and 10. A gas outlet channel 34 in communication with the fine particle outlet 5 of the classifying apparatus 19 is provided with a gas-solid separator 32 and with an overall gas flow regulating valve 33 for adjusting the flow of gas through the apparatus 19. The fine particles separated out and entrained in the gas through the outlet channel 34 can be collected in the separator 32. Indicated at 35 is gas discharging means.

The apparatus 19 is equipped with a computer 36 for controlling the number of revolutions N of the fan wheel 2 and the degree of opening of the valve 33 on the channel 34. The computer 36 comprises an arithmetic unit 37 storing the equation $$N = K \cdot (1/d) \cdot \sqrt{(Q/\rho s)}$$

where K is a constant for calculating the number N of revolutions of the fan wheel 2 from the classification standard particle size d, the density $\rho s$ of the particles to be treated, and the rate Q of gas flow into the outlet channel 34; and input unit 38 for feeding the standard particle size d, gas flow rate Q and particle density $\rho s$ to the arithmetic unit 37; a unit 39 for automatically adjusting the speed of the drive means 27 to maintain the number of revolutions N of the fan wheel 2 at a value calculated by the arithmetic unit 37; a unit 40 for automatically controlling the valve 33 to maintain the gas flow rate Q set by the input unit 33; etc. An operating unit 41 for the ratio control valve 31 is coupled to the input unit 38, through which the operator can set the second and third gas inlet channels 9 and 10 for the desired gas flow ratio.

The apparatus shown in FIG. 7 will be used and operate in the following manner.

Figure 8:
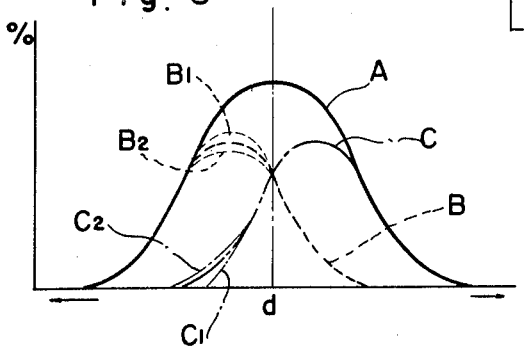
FIG. 8 is a graph showing the distribution of particle sizes for collected particles.

The operator feeds to the input unit 38 signals indicating the desired classification standard particle size d, the density $\rho s$ of the particle to be treated, and the flow rate Q of gas into the outlet channel 34 suited to the capacity of the gas discharging means 35. Through this procedure alone, the number of revolutions N of the fan wheel 2 and the degree of the opening of the valve 33 can be automatically maintained at proper values to assure the desired classification of the particles. It is now assumed that when particles having the size distribution indicated in a solid line A in FIG. 8 are classified at a standard particle size d under certain conditions, the resulting fine fraction has the size distribution indicated in a dot line B and the coarse fraction obtained has the size distribution indicated in a dot-and-dash line C. If the ratio control valve 31 is then operated to pass an increased gas flow through the third gas inlet channel 10, the dot line B and the dot-and-dash line C will partially change to a dot line $B_1$ and a dot-and-dash line $C_1$ respectively. If the gas flow through the channel 10 is reduced, the dot line B and the dot-and-dash line C will partially change to a dot line $B_2$ and a dot-and-dash line $C_2$ respectively. In this way, the ratio control valve 31, when operated, varies the particle size distribution of the fine or coarse fraction as desired.

The experiments conducted to explore the relation between the flow of gas through the second and third gas inlet channels 9 and 10 and the size distributions of the classified fractions have revealed that the size distribution of the fine particle fraction as well as of the coarse particle fraction is optionally variable with little or no variation in the standard particle size d, by altering the gas flow ratio between the second and third gas inlet channels 9 and 10 without altering the overall flow of gas through the classifying apparatus 19, namely, while maintaining the combined gas flow through the channels 9 and 10 and the gas flow through the first gas inlet channel 4 at substantially constant levels. This novel finding has matured to the present classifying apparatus which is convenient to operate and simple in overall construction and which assures optimal classification for giving fractions of accurate particle size or of specified particle size distribution.

The gas flow ratio between the second and third gas inlet channels 9 and 10 is variable while maintaining the combined gas flow therethrough at an approximately constant value, for example, by a throttle valve or throttle valves which are provided on either one or both of the channels 9 and 10 and which are individually operable or operatively associated with each other, or by capacity-variable blowers which are connected to the channels 9 and 10 respectively and the output of which is adjustable in operative relation to each other, or by various other means. Such means will be referred to collectively as "control means 31." For more efficient classification, it is required that the weight of the particles to be supplied through the first gas inlet channel 4 be maintained at an approximately constant value per unit amount of the gas. Exemplary of means useful for this purpose is one which is adapted to adjust the supply of the particles on detecting the variation of the flow rate of gas through the inlet channel 4. Such means will be referred to collectively as "particle supply adjusting means 29."

The number of revolutions N of the classifying fan wheel 2 is variable, for example, by any of various speed-change means provided between the fan wheel 2 and drive means operable at a constant speed. The fan wheel 2 may be one rotatable at a constant speed.

The signals to be fed to the computer 36 for the calculation of the number of revolutions N for the fan wheel 2 may be limited to one indicating the classification standard particle size d, or may be those indicating the standard particle size d and the rate of gas flow, Q, into the outlet channel 34 alone. In the former case, the equation to be stored in the computer 36 is:

$$N = Ka \cdot (1/d)$$

where Ka is a constant. In the latter case, the equation to be stored is as follows:

$$N = K \cdot (1/d) \cdot \sqrt{(q/Kb)}$$

where K and Kb are constants. Thus the equation to be stored in the computer 36 is variously changeable. While a microcomputer is satisfactorily serviceable as the computer 36, such computer can be modified variously in construction. The computer 36 can be dispensed with.

We claim:

1. An apparatus for classifying particles comprising, a main body (1) having a fine particle outlet (5) and a coarse particle outlet (6), a classifying fan wheel (2) rotatably disposed within the main body (1) and having an inside space in communication with the fine particle outlet (5), and a first gas inlet channel (4) communicating with the interior of the main body (1) for supplying the particles to be classified to the fan wheel (2) externally thereof along with a gas stream, the apparatus being characterized in that a gas passing member (7) is disposed within the main body (1) to surround the classifying fan wheel (2) at a suitable spacing and has a large number of gas inlets (15) opened toward the direction of rotation of the fan wheel (2), and the first gas inlet channel (4) is in communication with the interior of a classifying chamber (17) provided inside the gas passing member (7), a second gas inlet channel (9) communicating with the interior of a gas chamber (8) formed between the gas passing member (7) and the inner wall surface (14) of the main body (1).

2. An apparatus as defined in claim 1 characterized in that the third gas inlet channel (10) is disposed below the classifying chamber (17) in communication therewith.

3. An apparatus as defined in claim 2 characterized in that a pneumatically screening ring (13) is disposed below the gas passing member (7) substantially continuously with the member (7).

4. An apparatus as defined in claim 3 characterized in that the first gas inlet channel (4) has an opening (12) positioned close to a lower portion of the pneumatically screening ring (13).

5. An apparatus as defined in claim 3 characterized in that the first gas inlet channel (4) is in communication with the classifying chamber (17) at one side of the fan wheel (2) to supply the particles in the direction of rotation of the fan wheel (2).

6. An apparatus as defined in any one of claims 2 to 5 characterized in that there is provided control means (31) for varying the gas flow ratio between the second gas inlet channel (9) and the third gas inlet channel (10) while maintaining the combined gas flow therethrough at an approximately constant value.

7. An apparatus as defined in claim 6 characterized in that the first gas inlet channel (4) is provided with particle supply adjusting means (29) for maintaining the weight of the particles through the inlet channel (4) at an approximately constant value per unit amount of the gas.

* * * * *